US005477880A

United States Patent [19]

Carter et al.

[11] Patent Number: 5,477,880

[45] Date of Patent: Dec. 26, 1995

[54] "V" SHAPED CHECK STOP

[75] Inventors: Raymond D. Carter, Bryan; Kerry G. Vonalt, Edgerton, both of Ohio

[73] Assignee: The ARO Corporation, Bryan, Ohio

[21] Appl. No.: 359,323

[22] Filed: Dec. 22, 1994

Related U.S. Application Data

[63] Continuation of Ser. No. 212,636, Mar. 14, 1994, abandoned.

[51] Int. Cl.[6] ..... F16K 15/02

[52] U.S. Cl. ..... 137/533.27

[58] Field of Search ..... 137/519, 519.5, 137/533–533.31

[56] References Cited

U.S. PATENT DOCUMENTS

| | | | |
|---|---|---|---|
| 963,626 | 5/1910 | McCarty | 137/533.11 X |
| 1,764,186 | 6/1930 | Teesdale | 137/533.15 X |
| 2,401,856 | 6/1946 | Brock | 137/533.13 X |
| 4,071,045 | 1/1978 | Brandt | 137/533.11 X |
| 4,091,839 | 5/1978 | Donner | 137/533.13 |
| 4,155,374 | 5/1979 | Diehl | 137/533.15 X |
| 4,176,682 | 12/1979 | Diehl | 137/533.11 |

*Primary Examiner*—Robert G. Nilson
*Attorney, Agent, or Firm*—Walter C. Vliet

[57] ABSTRACT

A "V" shaped check stop is provided formed of spring steel or the like having a substantially greater depth than thickness to minimize frontal area in the direction of flow and further to provide for added resistance strength in the direction of flow and ease of installation in a circumferential groove on assembly.

2 Claims, 1 Drawing Sheet

" V" SHAPED CHECK STOP

This application is a continuation of application Ser. No. 08/212,636, filed Mar. 14, 1994, now abandoned.

BACKGROUND OF THE INVENTION

This invention relates generally to check valve stops and more particularly to a "V" shaped check stop for use with a pump check valve or the like. In the prior art the check stop has generally consisted of a machined casting with lugs or kidney slot washers having substantial projected area in direction of the flow resulting in reduced pump efficiency.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a "V" shaped check stop comprising a bent flat spring for insertion in a circumferentially confining circumferential groove of a pump body.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
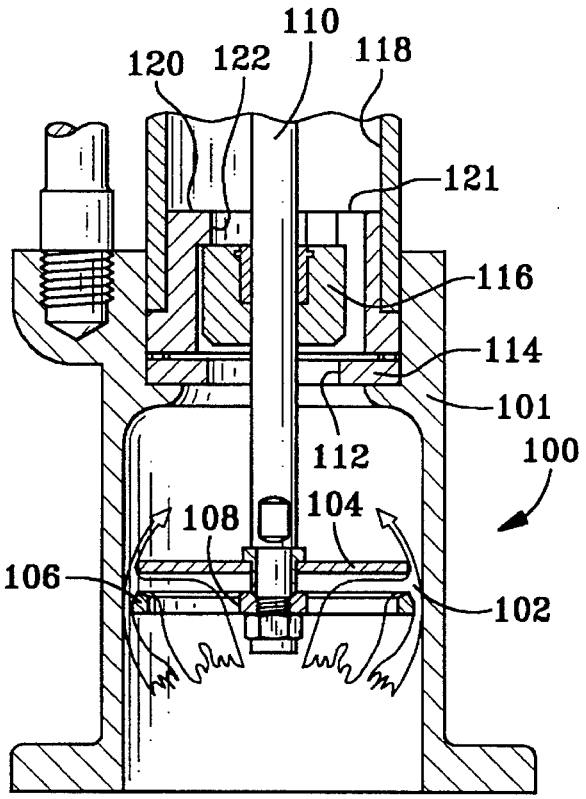
FIG. 1 (PRIOR ART)
FIG. 1 shows a partial elevation section of a check valve pump according to the prior art.

FIG. 1 shows a partial elevation sectional view of a prior art check valve 100 having a cylinder or housing 101 containing a primer valve 102 comprised of two valve plates 104 and 106. The valve plate 106 which has flow openings 108 therethrough is secured to the end of the reciprocally driven pump drive rod 110. The valve plate 104 is axially slidable on the drive rod 110 between a first position against the valve plate 106 precluding flow through the flow openings 108 and a second position spaced from the valve plate 106 as shown in FIG. 1 to permit flow of viscous material through the flow opening 108. The viscous material will pass through the opening 112 in valve seat 114 and about the lower floating check valve 116 into chamber 118 from which it can be pumped to a desired place, for example a storage tank.

According to the prior art, the floating check valve 116 is retained by a check stop 120 which is comprised of a machined or cast piece having a series of bypass passageways 121 circumferentially alternating with a series of rib stops 122 which limit the vertically upward travel of the lower floating check valve 116.

Figure 2:
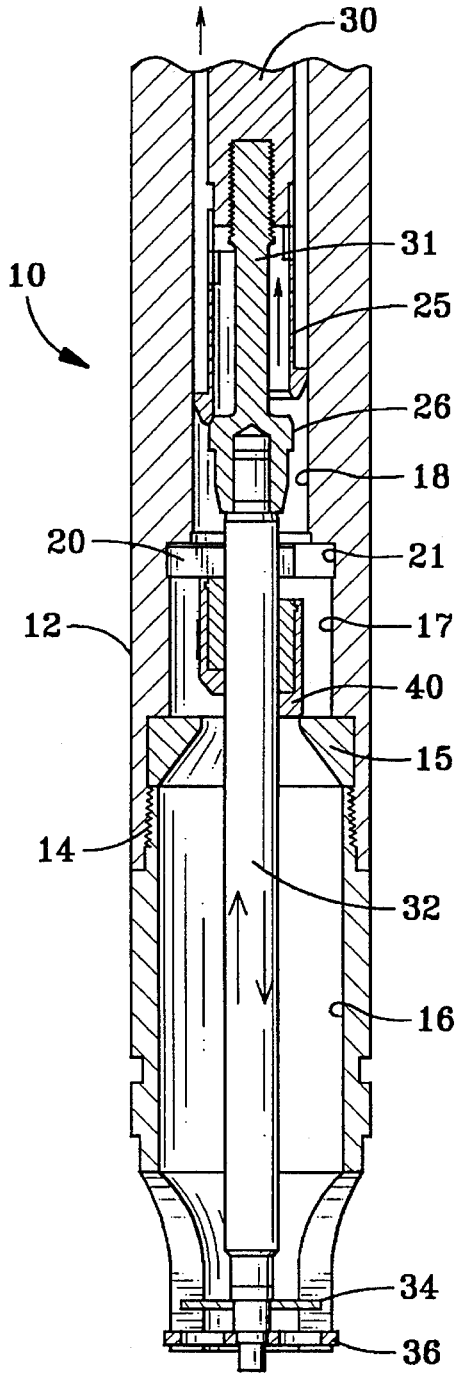
FIG. 2 shows a partial split elevation section of a check valve pump according to the present invention showing the check stop function for the upward stroke in the left half of the section and the shut-off function of the lower pump check in the right hand section.

Referring now to FIG. 2, there is shown the lower half of a chop-check pump according to the present invention. The lower end of the chop-check pump 10 is comprised of a cylindrical housing 12 formed in two sections and joined by a threaded portion 14. The cylindrical housing 12 is provided with a series of progressively decreasing diameter bores 16, 17, and 18, respectively. A valve seat 15 is secured in a circumferential groove formed by a land between bore 16 and 17 and the end face of the inner threaded portion of thread 14.

A "V" shaped check stop 20 according to the present invention is shown inserted in a circumferential groove 21 formed at the top of bore 17. It is retained there by the spring action of the stop 20. Bore 18 contains an upper floating check valve 25 which cooperates with an upper check valve seat 26. A reciprocating drive rod 30 provides reciprocating motion to the intermediate drive rod 31 which contains the upper check valve 25. The intermediate drive rod 31 in turn reciprocates the lower drive rod 32. Attached to the lower drive rod 32 are valve plates 34 and 36 which function in a manner similar to those shown in FIG. 1 (104 and 106).

A lower floating check valve 40 is provided in snug sliding engagement with the lower drive rod 32 such that the lower check valve 40 travels with the lower push rod 32 unless its progress is restricted either by the valve seat 15 or the "V" shaped check stop 20 according to the present invention.

In operation, as shown in the right hand portion of FIG. 2 on the downward stroke, the lower check valve 40 contacts the valve seat 15. Friction between the bore 18 and the upper check valve 25 causes it to slide away from upper check valve seat 26 thereby permitting the pumped fluid trapped above the valve seat 15 to bypass the upper check valve 25 for eventual delivery outside the pump. On the return stroke, as shown in the left hand side of FIG. 2, the upper check valve 25 is closed by sliding friction in the bore 18. In addition, the lower check valve 40 is withdrawn from the valve seat 15 by friction on the lower drive rod 32 permitting the pumped fluid compressed between the valve plates 34, 36 to bypass the seat 15 filling the chamber formed between the valve seat 15 and valve seat 26 where it next bypasses the upper check valve 25 on the downward stroke as previously described.

It should be appreciated by one skilled in the art that any resistance in the path of flow would adversely effect pump efficiency. For this reason the unique "V" shaped check stop according to the present invention is particularly suited for the particular viscous material normally encountered by the chop-check pump.

Figure 3:
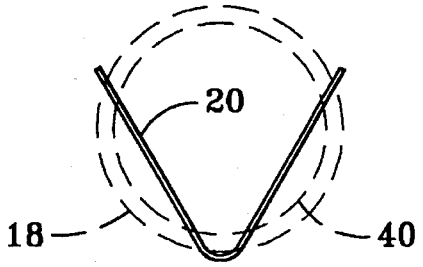
FIG. 3 shows a plan view of a "V" shaped check stop according to the present invention.

As seen in FIG. 3, the "V" shaped check stop according to the present invention presents a minimum amount of frontal area to the flow of a viscous material. The lower check valve 40 is shown in dotted lines as well as the diameter bore 18 to depict the interference configuration of the check stop with the lower check valve.

Figure 4:
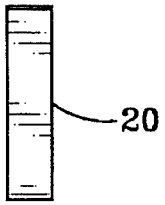
FIG. 4 is a side view of the check stop according to the present invention.

FIG. 4 shows the relative depth of the "V" shaped check stop compared to the thickness of the check stop 20 which greatly increases the strength of the stop in the direction of flow while permitting minimal interference with flow through the pump.

It should be appreciated by one skilled in the art that other flat spring configurations might be used to accomplish the purpose of the present invention.

We do not wish to be limited in the scope of our invention except as claimed.

What is claimed is:

1. A check stop comprising:

a bent flat spring formed in a "V" in one plane transverse to a direction of flow of fluid and having a leading edge and trailing edge relative to said direction of fluid flow spaced apart a greater distance than its thickness for insertion in a circumferentially confining circumferential groove of a pump body for maintaining the location of said spring in a plane perpendicular to fluid flow; said leading edge and said trailing edge defining the direction of fluid flow through the check.

2. A check stop according to claim 1, wherein said check stop is formed of bent steel.

* * * * *